US005639224A

United States Patent [19]

Schlossarczyk et al.

[11] Patent Number: 5,639,224

[45] Date of Patent: Jun. 17, 1997

[54] DEVICE FOR MONITORING PRESSURE OR TEMPERATURE IN A COMPRESSOR

[75] Inventors: Heinrich Schlossarczyk, Wennigsen; Jens Tiedemann, Gehrden, both of Germany

[73] Assignee: WABCO Vermögensverwaltungs-GmbH, Hanover, Germany

[21] Appl. No.: 270,156

[22] Filed: Jul. 1, 1994

[30] Foreign Application Priority Data

Jul. 3, 1993 [DE] Germany ..... 43 22 210.2

[51] Int. Cl.[6] ..... F04B 49/00

[52] U.S. Cl. ..... 417/298; 417/306; 417/307; 137/855; 251/326; 251/901

[58] Field of Search ..... 417/296, 298, 417/306, 307; 137/855; 251/901, 326

[56] References Cited

U.S. PATENT DOCUMENTS

| | | | |
|---|---|---|---|
| 2,155,236 | 4/1939 | Newell | 417/298 |
| 4,432,698 | 2/1984 | Shirakuma et al. | 417/298 |
| 4,459,085 | 7/1984 | Tonegawa | 417/298 |
| 5,017,099 | 5/1991 | Tan | 417/307 |

FOREIGN PATENT DOCUMENTS

| | | |
|---|---|---|
| 0122015 | 1/1989 | European Pat. Off. . |
| 1061475 | 7/1959 | Germany . |
| 3022062 | 12/1980 | Germany . |
| 3226491 | 2/1983 | Germany . |
| 3136949 | 3/1983 | Germany . |
| 3214713 | 10/1983 | Germany . |
| 3445743 | 6/1986 | Germany . |
| 3633644 | 4/1987 | Germany . |
| 3638974 | 5/1988 | Germany . |
| 3923882 | 6/1990 | Germany . |
| 4211068 | 5/1992 | Germany . |

*Primary Examiner*—Charles G. Freay

*Attorney, Agent, or Firm*—Meltzer, Lippe, Goldstein, et al.

[57] ABSTRACT

The inventive device produces compressed gas. It is provided with a compressor, wherein the compressor has a compression chamber (25), a suction chamber (10) and a pressure chamber (6). The compression chamber (25) can be connected to the suction chamber (10) via a suction valve (12, 21, 54) and to the pressure chamber (6) via a pressure valve (3). When the receiving-end pressure reaches a predetermined level, the pressure chamber (6) is connected to a compressed-air supply container (44). This connection is via a device for the discontinuation of compressing action (23, 51). In addition, the pressure in the pressure chamber (6) is monitored by a control valve (26), which is a sensing device with a control output (38). The sensing device (26) is designed to produce a control signal at the control output (38), when the pressure in the pressure chamber (6) or compression chamber (25) of the compressor reaches or exceeds a predetermined value. The control output (38) of the sensing device (26) is connected to a control input (15, 52) of a cut-off device for the discontinuation of the compressing action (23) or a switchable coupling (51). The control signal at the control output (38) of the sensing device (26) actuates the cut-off devices (23, 51), thereby discontinuing the compressing action.

17 Claims, 5 Drawing Sheets

DEVICE FOR MONITORING PRESSURE OR TEMPERATURE IN A COMPRESSOR

BACKGROUND OF THE INVENTION

The present invention relates to a device for the production of compressed gas, where compressing action is discontinued when the receiving-end pressure has reached a predetermined level. Such a device is known from DE-AS 1 061 475.

The known device for the production of compressed gas has a connection between a compression chamber and a suction chamber of the compressor. This connection discontinues air feeding to a receiving end when a predetermined pressure has been reached or exceeded on the receiving end. The compressor is then in the idling phase, where air is sucked from the suction chamber, or from the suction side, towards the compression chamber and is expelled again along the same path in the reverse direction. No air can now be conveyed through a compression regulating valve subjected to the receiving-end pressure.

When the pressure on the receiving end increases to a predetermined level, an idling valve is actuated to connect the compression chamber to the suction chamber. The idling valve is actuated by the compression regulating valve located between the outlet of the compressor and the receiving end.

When the internal cross-section of the pressure pipe going to the receiving end is reduced, e.g., through the deposit of oil or carbon, excessive dynamic pressure builds up in the compression chamber of the compressor. The increased pressure may cause an undesirable heating of the compressor.

The reduction in the cross-section of the pressure pipe progresses only at a slow pace. The compression regulating valve of the known device cannot recognize the cross-section reduction, since this valve only measures the pressure on the receiving-end. Therefore, the pressure in the compression chamber could rise to an unacceptably high value before the pressure at the receiving-end reaches the same level. Since the pressure is only measured at the receiving-end, the idling valve cannot be switched over at the proper time to connect the compression chamber to the suction chamber. Therefore, the compressing action is not discontinued at the proper time.

SUMMARY OF THE INVENTION

It is the object of the present invention to detect by simple means, an unacceptably high pressure increase in the compression chamber and discontinue the compressing action of the compressor.

In particular, the present invention offers the advantage of sustained monitoring of either the pressure in the compression chamber or the operating temperature of the compressor. This is in addition to monitoring the pressure at the receiving end. In the inventive device, the compressing action can be discontinued either by connecting the compression chamber to the suction chamber, or by separating the compressor from its drive. The compressing action is discontinued when the pressure in the compression chamber rises to an unacceptably high value.

A further advantage of the inventive device is that one cut-off device discontinues the compressing action when either a predetermined pressure has been reached on the receiving end or the pressure becomes unacceptably high in the compression chamber. Furthermore, the same cut-off device also discontinues the compressing action when the compressor temperature rises excessively.

This invention offers the further advantage that additional valve arrangements on the compressor or additional switching means on a switchable coupling are not required.

The present invention is directed to a device for the production of compressed gas. In one embodiment, the inventive device is provided with a compressor which provides a compressing action driven by a driving device. The compressor comprises a compression chamber (25), a suction chamber (10) and a pressure chamber (6). Furthermore, a suction valve (21, 12, 54) connects the compression chamber (25) to the suction chamber (10). Additionally, a pressure valve (3) connects the compression chamber (25) to the pressure chamber (6).

In another embodiment, the inventive device is provided with a pressure fluid connection (4) and a pressure fluid pipe (5). The pressure fluid pipe (5) connects the pressure chamber (6) to a receiving end which is a compressed-air supply container (44).

In still another embodiment, the inventive device is provided with a cut-off device (23, 52) and a sensing device (26). The cut-off device (23, 52) discontinues the compressing action when a receiving-end pressure reaches a predetermined value. The sensing device (26) outputs a control signal from a control output (38) when the pressure in the pressure chamber (6) or the operating temperature of a predetermined element of the compressor reaches a predetermined value. The control signal is inputted to a control input (16, 52) of the cut-off device (23, 51) and actuates the cut-off device (23, 51) thereby discontinuing the compressing action.

In a further embodiment, the cut-off device (23, 51) may be a controllable valve which connects the compression chamber (25) to a pressure fluid sink such as the atmosphere. Alternatively, the cut-off device (23, 51) may be a switchable coupling (51) which connects or disconnects the compressor to a drive element (49).

In yet another embodiment, the cut-off device (23, 51) is provided with a pneumatic control input (17,52) and a pressure-fluid actuated adjustable switching element (18) for the actuation of the cut-off device (23, 51). Alternatively, the cut-off device (23, 51) is provided with an electric control input and an electrically solenoid-actuated adjustable switching element.

In still another embodiment, the sensing device (26) is a temperature-sensitive device located in or on the compressor. This temperature-sensitive device has an electric control output which is connected to the electric control input of the cut-off device.

Alternatively, the sensing device (26) is a pressure-sensing device which is subjected to either the pressure of the pressure chamber (6) or the pressure of said compression chamber (25). The control output (38) is an electric control output outputting an electric control signal. This electric control signal is a function of either the pressure of the pressure chamber (6) or the pressure of the compression chamber (25) of the compressor. The electric control output of the pressure-sensing device is inputted to the electric control input of the cut-off device (23, 51). The pressure-sensing device outputs the electric control signal when the pressure of said pressure chamber (6) reaches a predetermined level.

In still another embodiment, the pressure-sensing or the temperature-sensing device has a solenoid-actuated valve which is electrically energized. The solenoid-actuated valve has an electric control input, a first pressure fluid input, a second pressure fluid input and a pressure fluid output which serves as an control output (38).

In still another embodiment, the sensing device (26) has a pressure regulating valve (45) which is located between said pressure chamber (6) and said receiving end (44). The pressure regulating valve (45) has a control output (46) which is connected to the first pressure fluid input of the solenoid-actuated valve.

The second pressure fluid input of the solenoid-actuated valve is connected to the pressure chamber (6), the compression chamber (25) or some other source of pressure fluid. The control output (38) of the solenoid-actuated valve is connected to a pneumatic control input (16, 52) of the cut-off device (23, 51). Additionally, the electric control input of the solenoid-actuated valve is connected to an electric control output of said pressure-sensing device.

The sensing device (26) connects the pneumatic input (16, 52) of the cut-off device (23, 51) to a source of pressure fluid in the presence of the electric control signal of the pressure-sensing device. In the absence of said electric control signal, the sensing device (26) connects the pneumatic input (16, 52) of the cut-off device (23, 51) to the control output (46) of the pressure regulating valve (45).

The sensing device (26) has a control chamber (28) and a control piston (39) which moves against a force of a spring element (36). The control chamber (28) is connected to the pressure chamber (6) or to the compression chamber (25) of the compressor. The side of the control piston (39) facing away from the spring element (36) delimits the control chamber (28).

In another embodiment, the sensing device (26) has a valve which is actuated by the control piston (39). This valve connects the source of pressure fluid to the control input (16, 52) of the cut-off device (23, 51).

The control piston (39) brings the valve into a position which connects the control input (16, 52) of the cut-off device (23, 51) to the source of pressure fluid when the pressure in the control chamber (28) is greater than the force of the spring element (36) acting on the control piston (39).

In still another embodiment, the valve of the sensing device (26) is a pressure fluid-actuated 3/2-way valve. It has a first pressure fluid connection (27), a second pressure fluid connection (34), and a third pressure fluid connection. The third pressure fluid connection serves as the control output (38) of the sensing device (26).

The first pressure fluid connection (27) is a control input of the valve and is connected to the pressure chamber (6) or the compression chamber (25) of the compressor. The second pressure fluid connection (34) is connected to a control output (46) of a pressure regulating valve (45). The pressure regulating valve (45) is located between the pressure chamber (6) or the compression chamber (25) of the compressor and the receiving end (44). The control output (38) of the sensing device (26) is connected to the control input (16, 52) of the cut-off device (23, 51). The control piston (39), control chamber (28), spring element (36) and the valve form the control valve (26).

In still another embodiment, the sensing device (26) also has a first pressure fluid connection (27) connected to the control chamber (28), a second pressure fluid connection (34) and a third control output (38). The first pressure fluid connection (27) is connected on one end to the control chamber (28) and on another end to the pressure chamber (6) or the compression chamber (25) of the compressor. The second pressure fluid connection (34) is connected to a control output (46) of a pressure regulating valve (45). The pressure chamber (6) of the compressor is connected to the pressure fluid source (44) and to a pressure fluid sink, via said pressure regulating valve (45).

The third control output (38) is connected to a pneumatic control connection (17) of the cut-off device (23, 51) which is located at the pneumatic control input (16, 52) of the cut-off device (23, 51). The first, second and third pressure fluid connections (27, 34, 38) are positioned so that the one end of the first pressure fluid connection (27) connected to the control chamber (28) is sealed off from the second control output (38) and from the third pressure fluid connection (34) by means of a valve element actuated by the control piston (39).

The third control output (38) is connected to the second pressure fluid connection (34) when the force of the pressure from the pressure chamber (6) or the compression chamber (25) of the compressor acting upon the control piston (39) is weaker than the opposing force of the spring element (36).

The one end of the first pressure fluid connection (27) connected to the control chamber (28) is connected to the third control output (38). The third control output (38) is sealed off from said second pressure fluid connection (34) by means of the valve element when the force of the pressure from the pressure chamber (6) or the compression chamber (25) of the compressor acting upon the control piston (39) is greater than the force of said spring element (36) acting upon said spring element (36) in the opposite direction.

The control piston (39) has an elastic- or spring-loaded component (31) located in an outer circumferential wall of the control piston (39). The spring-loaded component extends to an inner wall of the housing (35) of the control valve (26) containing the control piston (39) and interacts with at least one recess (30) in the inner wall of the housing (35) in the manner of a snap-in or catch connection.

BRIEF DESCRIPTION OF THE DRAWINGS

This invention is explained below in greater detail through the drawings, wherein.

DETAILED DESCRIPTION OF PREFERRED EMBODIMENTS OF THE INVENTION

Figure 1:
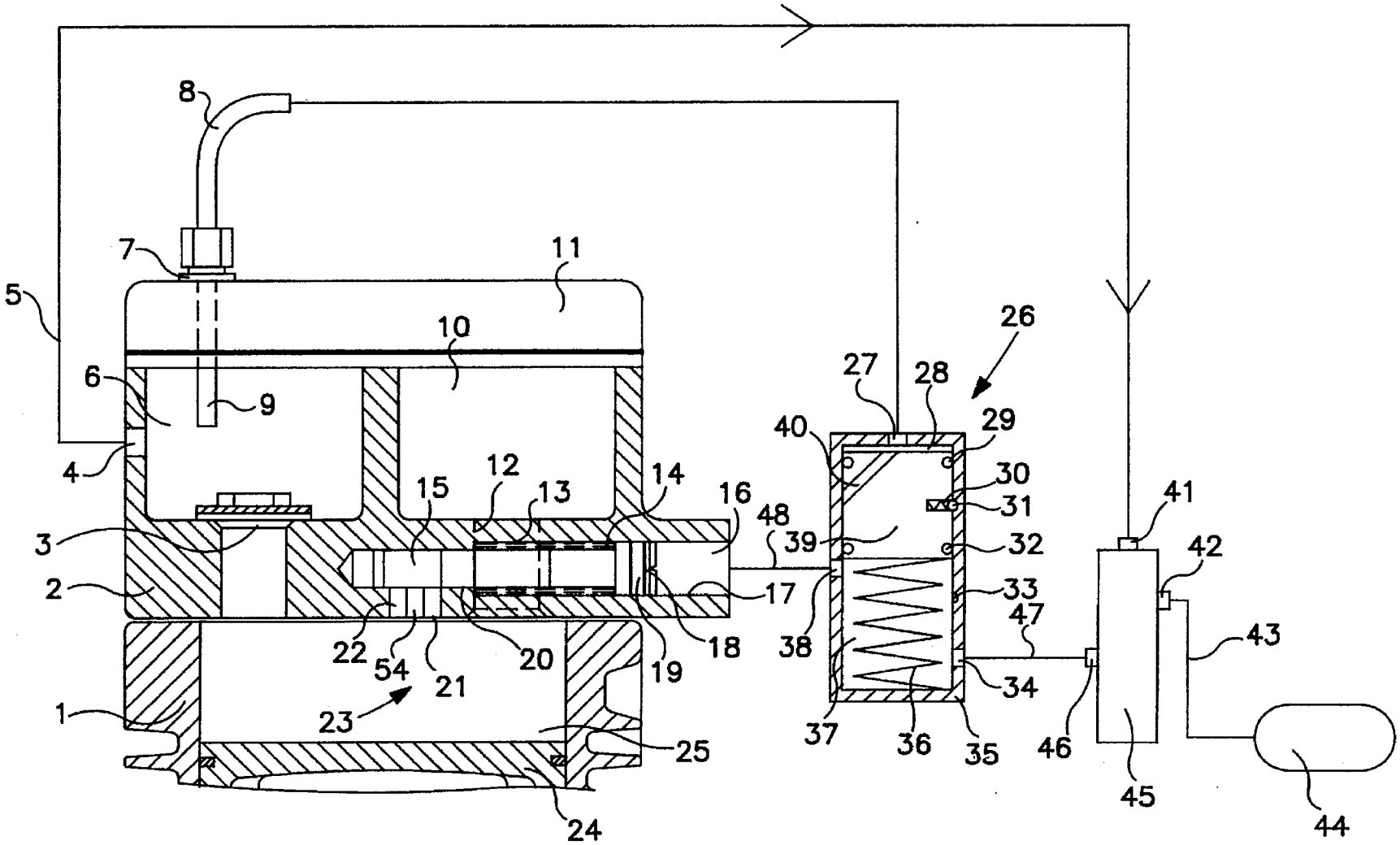
FIG. 1 shows an embodiment of the invention for a compressor with idling valve.

FIG. 1 shows an illustrative embodiment of the present invention. It shows a compressor consisting essentially of a cylinder (1) with a cylinder head (2) and a cylinder head cover (11). The cylinder (1) is provided with a compression chamber (25), delimited on one side by the cylinder head (2) and on another side by a piston (24) capable of moving in the direction of the longitudinal axis of the cylinder (1). A suction chamber (10) and a pressure chamber (6) are provided in the cylinder head (2). The compression chamber (25) can be connected via a suction valve (12, 21) to the suction chamber (10) and via a pressure valve (3) to the pressure chamber (6).

The suction valve (12, 21) consists of a bore (12) and a disk (21). The end of the bore (12) facing the compression chamber (25) is designed as a valve seat for the disk (21). This disk (21) serves as a valve body. When negative pressure prevails in the compression chamber (25), the disk (21) is lifted off the valve seat of bore (12) so that the suction chamber (10) is then connected to the compression chamber (25). The suction chamber (10) is connected to the atmosphere in a manner not specifically shown in FIG. 1.

The pressure valve (3) functions as a check valve, i.e., a one way valve. It connects the compression chamber (25) to the pressure chamber (6) when the pressure in the compression chamber (25) is higher than the pressure in the pressure chamber (6).

The pressure chamber (6) of the compressor is connected to an input (41) of a pressure regulating valve (45). This connection is via a pressure fluid connection (4) and a pressure fluid pipe (5) serving as a conveying pipe. An output (42) of the pressure regulating valve (45) is connected to a user in the form of a compressed-air supply container (44) which, in turn, serves as a pressure fluid source of a compressed-air installation.

A pressure regulating valve of a type which could be used here is known under instrument No. 975 303 061 0 from the publication "Description of the Compressed-Air Elements in Vehicle Brakes", edition of March 1989 of the firm WABCO Westinghouse Fahrzeugbremsen GmbH.

The cylinder head (2) contains a graduated bore (13, 20) extending essentially at a right angle to the longitudinal axis of cylinder (1). A switching piston (18), equipped with a sealing element (19), is installed in the area (13) with the larger cross-section of the graduated bore (13, 20). This installation allows the switching piston (18) to be displaced in a sealed manner against the force of a spring element (14). Illustratively, the spring element (14) is in the form of a flat coil spring.

The switching piston (18) is connected to a switching rod (15) which moves in the area (20). The area (20) is the smaller cross-section of the graduated bore (13, 20). A free end of the switching rod (15) extends into a recess (22) of the cylinder head (2). The switching piston (18) and the switching rod (15) constitute a pressure-fluid-actuated switching or adjusting element (18, 15).

The disk (21), which is in the form of a sliding disk, is capable of being moved in the recess (22) at a right angle to the longitudinal axis of the cylinder (1). The disk (21) is articulately connected to the switching rod (15) via a pin (54).

The disk (21) is oriented in relation to the bore (12) of the suction valve (12, 21) so that it is pushed away from the valve seat of bore (12) when the adjusting element (18, 15) moves against the force of the spring element (14). This action connects the compression chamber (25) to the suction chamber (10) of the compressor.

The switching piston (18), the switching rod (15), the disk (21) and the bore (12) constitute an idling valve (21, 12, 15, 18). The idling valve (21, 12, 15, 18) discontinues the compressing action of the compressor when the receiving-end pressure has reached a certain level. This certain pressure level can be predetermined by means of the pressure regulating valve (45). The idling valve (21, 12, 15, 18) thus serves as a device to discontinue the compressing action.

To discontinue the compressing action, the portion of area (13) of the graduated bore (13, 20) on the side of the switching piston (18) and away from the switching rod (15) is designed as a control chamber (16). A pneumatic control connection (17) connects the control chamber (16) to a control output (46) of the pressure regulating valve (45). This connection is via a sensing device (26, 47, 48) which consists of a control valve (26) and pressure fluid pipes (47, 48).

A pressure fluid connection (9, 7) consisting of a pipe (9) and a holding screw (7) is provided. The holding screw (7) is located on the cylinder head cover (11) with the pipe (9) going through it. The pipe (9) extends into the pressure chamber (6) of the cylinder head (2). The pressure fluid connection (9, 7) is positioned so that the input opening into the pressure chamber (6) is located in the compressed-air flow going from the pressure valve (3) to the pressure fluid connection (4). A pressure fluid pipe (8) goes from the pressure fluid connection (9, 7) to a first pressure fluid connection (27) of the control valve (26). The first pressure fluid connection (27) is a control input to the control valve (26) which is part of the sensing device (26, 47, 48).

A second pressure fluid connection (34) of the control valve (26) is connected, via a pressure fluid pipe (47), to the control output (46) of the pressure regulating valve (45). A third pressure fluid connection (38) of the control valve (26), which serves as a control output, is connected via the pressure fluid pipe (48) to the control input (17) of the idling valve (21, 12, 15, 18).

Illustratively, the control valve (26) is designed as a pressure control valve, in which the pressure in the control valve (26) serves both as a control pressure and an actuating pressure. Additionally, it is also possible to use a simple control valve as the control valve (26) which serves as a sensing device. With the simple control valve configuration, the control pressure could be the pressure of a separate pressure fluid source. For example, the control pressure could be the pressure of the compressed-air supply container (44).

The control valve (26) has a housing (35). The housing (35) comprises a first pressure fluid connection (27), a second pressure fluid connection (34) and a third pressure fluid connection (38). A control piston (39) located inside the housing (35) can be moved along the longitudinal axis of the housing (35). The control piston (39) moves against the force of a spring element (36), which is in the form of a flat coil spring. The control piston (39) divides the interior of the housing into first and second pressure fluid chambers (37) and (28) respectively. The spring element (36) is located inside the first pressure fluid chamber (37). The second pressure fluid chamber, which serves as a control chamber (28), is located across from the first pressure fluid chamber (37), on the other side of the control piston (39).

The control chamber (28) is connected to the first pressure fluid connection (27), which serves as a control input. Similarly, the first pressure fluid chamber (37) is connected to the second pressure fluid connection (34). The third pressure fluid connection (38), which serves as a control output, is connected to the first pressure fluid chamber (37) when the control piston (39) is in a first position. When the control piston (39) is in a second position, the third pressure fluid connection (38) is connected to the control chamber (28) via the bore (40). The bore (40) starts at the face of the control piston (39) and goes through the control piston (39) towards the control chamber (28). The bore (40) extends to the outer sleeve surface of the pressure fluid connection (38). The location of the bore (40) coincides with the third pressure fluid connection (38).

The control piston (39) has two sealing rings (29, 32) on its circumference. These two sealing rings (29, 32) are located in such a manner that the end of the bore (40), located at the outer sleeve surface of the control piston (39), is between the two sealing rings (29, 32).

The two sealing rings (29, 32) prevent a connection between the control chamber (28) and the first pressure fluid chamber (37). Furthermore, they also prevent an unwanted connection between the control chamber (28) and the third pressure fluid connection (38).

An elastic or spring-loaded component (31) extending towards the inner wall of the housing (35) is located in the outer circumferential surface of the control piston (39). In a first switching position of the control piston (39), the component (31) extends into a recess (30) in the inner wall of the housing (35). In a second switching position of the control piston (39), the component (31) extends into a second recess (33) in the inner wall of the housing (35). A snap-in or catch connection is established between the housing (35) and the control piston (39). This snap-in connection is by means of the component (31) and the first recess (30) as well as the second recess (33).

When the pressure in the control chamber (28) rises above a certain level, the snap-in connection causes the control piston (39) to be suddenly brought from the first position to the second position. This sudden shift in position occurs when the pressure in the control chamber (28) rises to a level where the force exerted by this pressure on the control piston (39) becomes greater than an opposite force exerted by the spring element (36). Inversely, the pressure fluid connection (38) is brought suddenly from its second position into its first position when the force of the spring element (36) is greater than the pressure in the control chamber (28).

Illustratively, in this embodiment of the present invention, the control piston (39) along with the pressure fluid connections (27, 34, 38) form a valve (39, 27, 34, 38). The valve (39, 27, 34, 38) connects the control connection (17) of the device for the discontinuation of compressing action (23) to a source of pressure fluid, e.g., the compressed-air supply container (44).

The compressed-air supply container (44) is connected to the valve (39, 27, 34, 38) via control output (46) and output (42) of the pressure regulating valve (45). Therefore, in this embodiment, the control connection (17) of the device for the discontinuation of the compressing action (23) is connected either to the pressure chamber (6), the compression chamber (25), or the compressed-air supply container (44).

The control piston (39), together with the spring element (36) serving as pressure or force-sensing element, constitute a pressure- or force-sensing device (39, 36). The pressure-sensing device (39, 36) senses the pressure of the pressure chamber (6) or of the compression chamber (25) of the compressor. Furthermore, the control piston (39) with the pressure fluid connections (27, 34, 38), constitute the above-mentioned valve (39, 27, 34, 38).

It is also possible to design the pressure or force-sensing device (39, 36) as a separate valve, independent from a valve having the pressure fluid connections (27, 34, 38). This separate valve would then be provided with passages for pressure fluids and a control slide interacting with the passages. Alternatively, the separate valve would consist of one or several valve seats and one or several sealing elements interacting with these.

This separate valve would then be actuated directly by either the piston of the pressure or force-sensing device or a ram placed between the piston and the valve. Illustratively, such a valve could be made in the form of a 3/2-way valve.

The pressure or force-sensing element, e.g., the spring (36), or the pressure or force-sensing device (39, 36), determines at which level of pressure in the pressure chamber (6) or the compression chamber (25) of the compressor the separate valve is switched. The separate valve is switched and the compressing action is discontinued when the pressure from the pressure chamber (6) at the control input connection (27) is greater than the force exerted by the spring (36) on the piston (39).

The switched separate valve connects the pressure chamber (6) to a pressure fluid sink, e.g., the atmosphere. Therefore, the compressing action is discontinued. The switched separate valve vents the control input (27) of the device (39, 36) to the atmosphere. The vented control input (27) also vents the pressure chamber (6), the compression chamber (25), and the pneumatic control connection (17) of the device (23), since they are connected to the vented control input (27). The device (23) is in a switched position that connects the compression chamber (25) to the suction chamber (10), which is in turn connected to the atmosphere. This connection discontinues the compressing action.

The operation of the above-described device is explained below in further detail.

In the conveying phase of the compressor, air is sucked from the atmosphere via suction valve (12, 21) and is compressed in the compression chamber (25). The compressed air is conveyed via the pressure valve (3) into the pressure chamber (6). The compressed air goes from the pressure chamber (6) to the compressed-air supply container (44) through the pressure fluid connection (4), the pressure fluid pipe (5), and the pressure regulating valve (45). At the same time, the compressed air goes from the pressure chamber (6) of the compressor into the control chamber (28) of a control element in the form of the control valve (26). This path is through the pipe (9) and the pressure fluid pipe (8).

Initially, the control piston (39) does not change positions because when the pressure in the pressure chamber (6) of the compressor is normal, the force of this pressure acting on the control piston (39) of the control valve (26) is less than an opposing force. The opposing force is exerted by the spring element (36) acting upon the control piston (39).

While the pressure is normal, the control chamber (28) of the control valve (26) is sealed off from its control output (38). That is there is no output signal at the control output (38) of the sensing device (26). Instead, the control output (38) is connected to the first pressure fluid chamber (37) of the control valve (26) in the first position of the control piston (39).

When the pressure on the receiving end, i.e., the pressure in the compressed-air supply container (44), has reached a level predetermined by the pressure regulating valve (45), the pressure regulating valve (45) switches over. This switching disconnects the pressure fluid pipe (5) from the output (42) of the pressure regulating valve (45). Furthermore, the switching connects the pressure fluid pipe (5) to the control output (46) of the pressure regulating valve (45).

Compressed air now goes from the pressure fluid pipe (5) into the first pressure fluid chamber (37) of the control valve (26). The path is via the pressure regulating valve (45), the control output (46), the pressure fluid pipe (47) and the second pressure fluid connection (34) of the control valve (26). Next, this compressed air goes through the control output (38) of the control valve (26) and into the control chamber (16) of the idling valve (12, 21, 18, 15, 16). In this manner, the control chamber (16) is subjected to the pressure of the pressure chamber (6).

The pressure building up in the control chamber (16) displaces the switching piston (18) and the switching rod

(15) against the force of the spring (14). The switching rod (15) moves the disk (21) via pin (54) away from the valve seat of the bore (12) of the suction valve (12, 21). This places the suction valve (12, 21) in the open position. In this open position, the compression chamber (25) is now connected to the atmosphere via the suction valve (12, 21) and the suction chamber (10).

While the suction valve (12, 21) is in the open position, the effect of the compressor operation is as follows. During a suction stroke of the piston (24), air is sucked from the atmosphere through the suction chamber (10) and the suction valve (12, 21) into the compression chamber (25). However, during the next compression stroke of the piston (24), the air is expelled back into the atmosphere through the same path, but in the reverse direction. That is, the air from the compression chamber (25) is expelled into the atmosphere through the suction valve (12, 21) and the suction chamber (10). Thus the compressing action is discontinued.

When the pressure in the compressed-air supply container (44) falls below the predetermined pressure, the pressure regulating valve (45) switches back. This switching bleeds off the pressure in the control chamber (16) of the device (23) into the atmosphere. Next, the force of the spring (14) pushes back the switching piston (18) with the switching rod (15) of the idling valve into the starting position. This pushes back the disk (21) into the starting position which closes the bore (12) and places the suction valve (12, 21) in the closed position.

Now, with the suction valve (12, 21) in the closed position, the compressing action is resumed. During an operating stroke of the piston (24) of the compressor, the air in the compression chamber (25) is compressed and conveyed through the pressure valve (3) into the pressure chamber (6). The compressed air in the pressure chamber (6) goes into the compressed-air supply container (44) through the pressure fluid pipe (5) and the pressure regulating valve (45). Each suction stroke of the piston (24) of the compressor places the suction valve (12, 21) in the open position, whereas each compression stroke of the piston (24) places the suction valve (12, 21) in the closed position. That is, the suction valve (12, 21) acts as a one-way valve, allowing air movement only in one direction. This direction is only from the suction chamber (12) to the compression chamber (25) and not in the reverse direction.

The level of the receiving-end pressure is monitored by means of these above-mentioned measures. Additionally, the inventive device monitors the pressure in the compression chamber (25) and the pressure chamber (6).

To be able to monitor the level of pressure in the compression chamber (25) and the pressure chamber (6), the pressure in the pressure chamber (6) is conveyed to the control chamber (28) of the control valve (26). This is accomplished through the pipe (9) and the pressure fluid pipe (8). The pressure from the pressure chamber (6) pushes the control piston (39) of the control valve (26) against the force of the spring (36).

As long as the pressure in the pressure chamber (6) does not exceed a predetermined value, the spring (36) is designed so that the control input connection (27) of the control valve (26) is isolated from its control output (38). Therefore, the control valve (26) keeps the control chamber (17) of the device (23) sealed off from the pressure chamber (6) or the compression chamber (25) of the compressor.

Due to the deposit of oil carbon or for other reasons, the passage cross-section of the pressure fluid pipe (5) could decrease. This cross-section could decrease to such an extent that the compressed air in the compression chamber (25) and in the pressure chamber (6) of the compressor can no longer flow unhindered through the pressure regulating valve (45) to the compressed-air supply container (44). This increases the pressure in the pressure chamber (6) and in the compression chamber (25) of the compressor. Since the control chamber (28) of the control valve (26) is connected via the pressure fluid pipe (8) and the pipe (9) to the pressure chamber (6) of the compressor, the accumulating pressure in the pressure chamber (6) also increases in the control chamber (28) of the control valve (26).

When the pressure in the pressure chamber (6) of the compressor and, thereby, also in the control chamber (28) of the control valve (26) rises above the maximum value predetermined by the spring (36) of the control valve (26), then the control piston (39) is suddenly brought from the first switching position into the second switching position and is held in the second switching position by means of the catch or snap-in device (30, 31, 33). The pressure increase above the maximum value predetermined by the spring (36) renders the force exerted by the pressure in the control chamber (28) on the control piston (39) greater than the opposing force of the spring (36) acting upon the control piston (39). In the first switching position of the control piston (39), the second pressure fluid connection (34) is connected to the control output (38) and the control output (38) is sealed off from the control chamber (28). In the second switching position of the control piston (39), the control output (38) is connected to the control chamber (28) and the second pressure fluid connection (34) is sealed off from the pressure fluid connection (38).

Next, pressure fluid from the pressure fluid pipe (8) goes from the control chamber (28) into the control chamber (16) of the idling valve (12, 21, 15, 18, 14, 16) through the bore (40) in the control piston (39), the control output (38) and the pressure fluid pipe (48).

The pressure building up in the control chamber (16) displaces the switching piston (18) and, thereby, also displaces the switching rod (15) via pin (54) against the force of the spring (14). The disk (21) is swivelled by the switching rod (15) in such a manner that it frees the valve seat of the bore (12). This opens the suction valve (12, 21). The compression chamber (25) is now connected to the suction chamber (10) via the open suction valve (12, 21).

During a suction stroke of the piston (24) of the compressor, air is sucked from the atmosphere into the suction chamber (10) through the suction valve (12, 21). During a compression stroke of the piston (24), the sucked air is again expelled into the atmosphere through the open suction valve (12, 21) and the suction chamber (10). Air in the compression chamber (25) is thus no longer compressed. Furthermore, this air can no longer reach the compressed-air supply container (44) through the pressure chamber (6) and the pressure fluid pipe (5) and the pressure regulating valve (45). This occurs despite the pressure on the receiving end having not yet reached the predetermined pressure value. Thus, compressing action is discontinued.

When the pressure in the pressure chamber (6) or in the compression chamber (25) of the compressor has reached or exceeded a predetermined value, a control signal is always produced at the control output (38) of the control valve (26). The control valve (26) is a sensing device. This control signal is transmitted to the control input (16) of the device (23) for the discontinuation of the compressing action.

When a driver of a vehicle containing the compressor recognizes the reason for the forced discontinuation of the compressing action, the driver can re-actuate the compressing action for a limited time, e.g., through manual switching-over of the control valve (26), in order to drive to the next repair shop, for example. Alternatively, the driver can decide to have the necessary repairs made immediately, e.g., replace the narrowed pressure pipe.

When the pressure pipe is replaced, the control chamber (28) of the control valve (26) is necessarily vented. The control valve (26) is switched over by the force of the spring (36) into the first switching position. If the spring (36) is not designed to be strong enough to be able to move the control piston (39) from the snapped-in second switching position back into the first switching position, then the control piston (39) is reset manually. However, if the snap-in means are designed accordingly, then manually opening the snap-in connection returns the control piston (39) to the starting position by the force of the spring (36).

The catch or snap-in means is not limited to the embodiments shown in the drawing. The only significant factor is to hold the control valve (26) or the control piston (39) in the second switching position upon occurrence of an excessively high pressure rise in the pressure chamber or in the compression chamber of the compressor.

If the control valve (26) is designed so that the spring (36) is able to return the control piston (39) from the second switching position to the first switching position, following the drop of pressure in the control chamber (28) below a predetermined value, then the process described below takes place.

When compressed air is no longer fed into the pressure chamber (6) after the discontinuation of compressing action, the pressure in the pressure chamber (6) bleeds off the through pressure fluid pipe (5) and the pressure regulating valve (45). Therefore, the pressure in the control chamber (28) of the control valve (26) also falls.

When the pressure in the pressure chamber (6) of the compressor and, thereby, also the control chamber (28) of the control valve (26), falls below the value predetermined by the spring (36) of the control valve (26), the force exerted by the pressure in the control chamber (28) on the control piston (39) becomes weaker than the opposing force of the spring (36) on the control piston (39). This causes the control piston (39) to suddenly move back into its first switching position by the force of the spring (36).

Furthermore, the control output (38) is again sealed off from the control chamber (28). Instead, the control output (38) is connected to the second pressure fluid connection (34).

The pressure in the control chamber (16) of the idling valve (12, 21, 15, 18, 14, 16) bleeds off into the atmosphere through the first pressure fluid chamber (37) of the control valve (26), the pressure fluid pipe (47) and the pressure regulating valve (45).

The force of the spring (14) causes the switching piston (18) with the switching rod (15) of the idling valve (12, 21, 15, 18, 14, 16) to return into the starting position. The switching rod (15) moves the disk (21) onto its valve seat thus closing the bore (12).

In this position, the compressor can now again compress air sucked in through the suction valve (12, 21) and convey it through the pressure valve (3) and the pressure chamber (6) into the pressure fluid pipe (5).

With a control valve of this design, it is especially important to connect a signalling device to the control valve (26). This signalling device informs the driver of the vehicle of a switching over of the control valve (26) from the first switching position into the second switching position.

An idling valve connecting the compression chamber (25) to the suction chamber (10) may be used as the device for the discontinuation of compressing action. The idling valve can be combined with the suction valve (12,21), as described above with regards to a sliding disk.

It is also possible to design the idling valve as a separate valve, i.e., independent of the suction valve (12, 21) or the pressure valve (3). It is also possible to mount the idling valve on the cylinder (1), the cylinder head (2) or the cylinder head cover (11). The idling valve may also be in the form of a simple seat valve. It may be placed so that it connects the pressure chamber (6) or the compression chamber (25) to the atmosphere or to some other pressure fluid sink when it receives a control signal to that effect.

Therefore, the device for the discontinuation of compressing action is a controllable valve through which the compression chamber can be connected to a pressure fluid sink.

Figure 2:
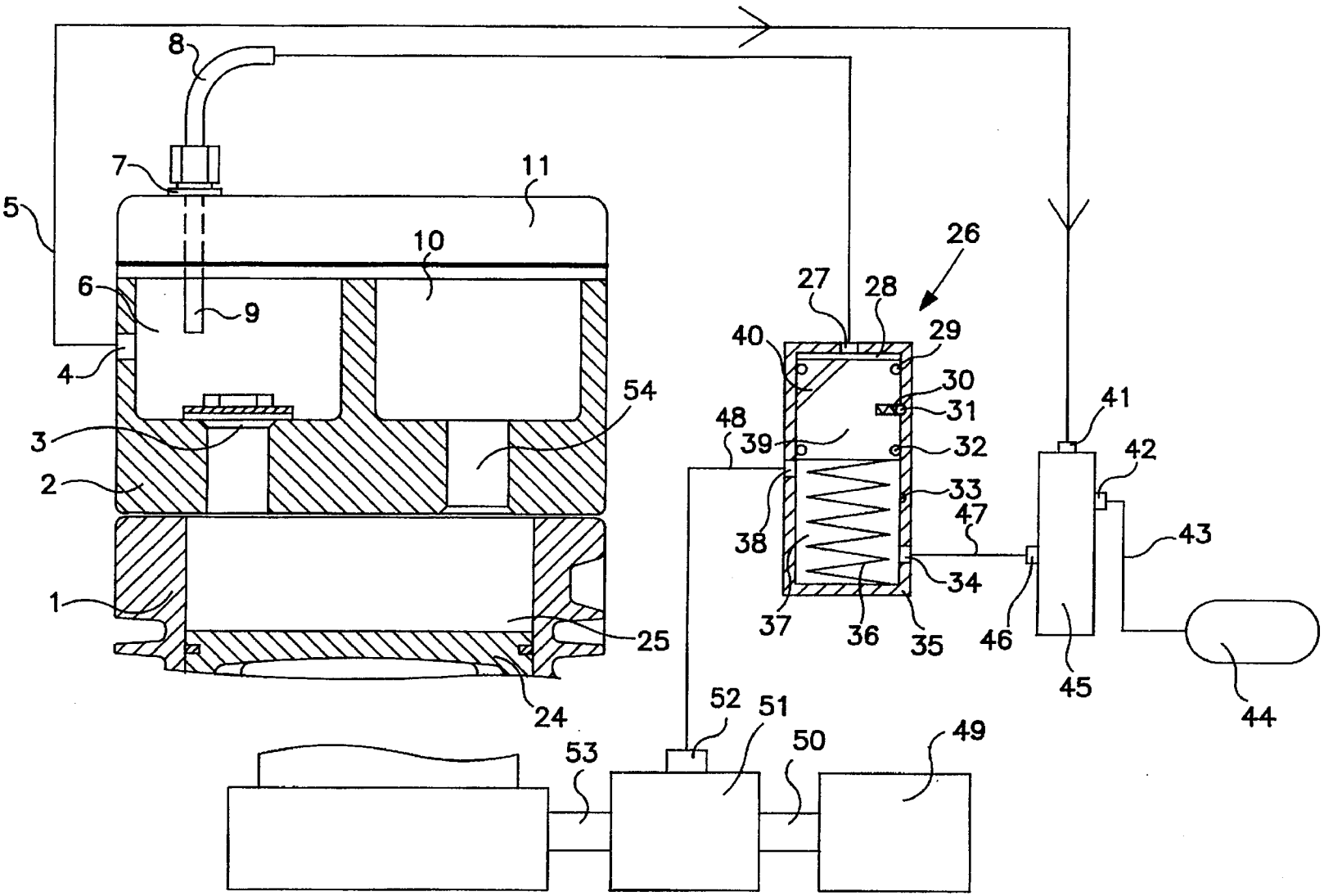
FIG. 2 shows another embodiment of the invention for a compressor with switchable coupling.

FIG. 2 shows a compressor driven by a motor via a coupling. For the sake of greater clarity the components which are identical with the components shown in FIG. 1 are given the same reference numbers.

The compressor shown in FIG. 2 consists essentially of a cylinder (1), a cylinder head (2) and a cylinder head cover (11). The cylinder (1) is provided with a compression chamber (25) which is delimited on the one side by the cylinder head (2) and on the other side by a piston (24) moving in the direction of the longitudinal axis of the cylinder (1). A suction chamber (10) and a pressure chamber (6) are provided in the cylinder head (2). The compression chamber (25) can be connected via a suction valve (54) to the suction chamber (10) and via a pressure valve (3) to the pressure chamber (6).

The pressure chamber (6) is connected to a pressure fluid input (41) of a pressure regulating valve (45) via a pressure fluid connection (4) and a pressure fluid pipe (5). A pressure fluid connection (42) of the pressure regulating valve (45) is connected via a pressure fluid pipe (43) to a pressure fluid source. The pressure fluid source is in the form of a compressed-air supply container (44) that feeds a compressed-air system (not shown) of a vehicle.

A driving device constituted by the vehicle engine (49) or by some other aggregate is used to drive the compressor. A drive shaft (50) of the engine (49) is connected via a switchable coupling (51) to the drive shaft (53) of the compressor. The switchable coupling (51) is provided with a pressure-fluid actuated switching or actuating element which can be subjected to pressure fluid via a pneumatic control connection (52).

The control connection (52) is connected via a pressure fluid pipe (48) to the control output (38) of a control valve (26) which serves as a sensing device. In this embodiment the control valve (26) has the same structure as the control valve in the embodiment according to FIG. 1.

The control input (27) of the control valve (26) is connected to the pressure chamber (6) of the compressor via a pressure fluid pipe (8) and a pipe (9) screwed to the cylinder head (11) of the compressor and extending into the pressure chamber (6). A pressure fluid connection (34) of the control valve (26) is connected via a pressure fluid pipe (47) to a control output (46) of the pressure regulating valve (45).

The control valve (26) is provided with a control piston (39) which can be moved against the force of a spring (36). The control piston (39) divides the interior of the valve housing (35) into a first pressure fluid chamber (37) and a second pressure fluid chamber serving as control chamber (28). Furthermore, the control piston (39) is designed so that it is able to carry out the functions of a valve element. The control piston (39), together with the three pressure fluid connections (27, 34, 38), constitute a valve. This valve connects the control connection (52) of the switchable coupling (51) to either the control output (46) of the pressure regulating valve (45) or to the control pressure source of the control chamber (28) of the control valve (26). The switchable coupling (51) serves as a device for the discontinuation of compressing action. The operation of the above-described device is explained in further detail below.

In normal operation, the compressor is driven by the engine (49) via the switchable coupling (51). During a suction stroke of the piston (24), air is sucked through the suction chamber (10) and the suction valve (54) into the compression chamber (25). During the subsequent compression stroke of the piston (24), the air in the compression chamber (25) is compressed and enters the pressure chamber (6) via the pressure valve (3). From the pressure chamber (6), the compressed air flows through the pressure fluid pipe (5), the pressure regulating valve (45) and the pressure fluid pipe (43) into the compressed-air supply container (44).

At the same time compressed air goes from the pressure chamber (6), through the pipe (9) and the pressure fluid pipe (8), into the control chamber (28) of the control valve (26). The control valve (26) serves as a pressure measuring element. As long as the pressure in the pressure chamber (6) of the compressor does not exceed a maximum value determined by the spring (36) of the control valve (26), the control piston (39) and, thereby, the control valve (26), remain in a first switching position. In the first switching position, the second pressure fluid connection (34) is connected to the control output (38) and the control output (38) is sealed off from control chamber (28).

When the pressure on the receiver end, i.e., the pressure in the compressed-air supply container (44), has reached a predetermined value, the pressure regulating valve (45) switches over. The compressed air from the pressure fluid pipe (5), which is the compressed air of the pressure chamber (6) of the compressor, is delivered to the pneumatic switching element of the switchable coupling (51). This connection from the pressure fluid pipe (5) to the switchable coupling (51) is through the control output (46) of the pressure regulating valve (45), the pressure fluid pipe (47), the first pressure fluid chamber (37) of the control valve (26), the pressure fluid pipe (48) and the control connection (52). The control connection (52) serves as a device for the discontinuation of compressing action. This coupling (51) switches over in such a manner that it breaks the connection between the drive shaft (50) of the engine (49) and the drive shaft (53) of the compressor. Since the piston (24) of the compressor is no longer able to execute a stroke, the action of the compressor is discontinued.

The pressure regulating valve (45) switches over when the pressure in the compressed-air supply container (44) falls below the predetermined value. This decrease in pressure could be due to consumption of the compressed air in the compressed-air systems connected to the compressed-air supply container (44). The pressure decrease switches over the pneumatic switching element of the switchable coupling (51). The connection between the compressed-air supply container (44) and the switchable coupling (51) is vented via the pressure fluid pipes (48, 47). The pressure fluid pipes (48, 47) connect the control connection (52) of the switchable coupling (51), via the control valve (26), to the control output (46) of the pressure regulating valve (45).

In turn, the switchable coupling (51) connects the drive shaft (50) of the engine (49) to the drive shaft (53) of the compressor. Air flows through the suction chamber (10) and the suction valve (54) into the compression chamber (25). This air is compressed in a compression stroke of the piston (24). The compressed air goes through the pressure valve (3) into the pressure chamber (6). Thereafter, the compressed air flows from the pressure chamber (6) to the compressed-air supply container (44). This flow is through the pressure fluid pipe (5), the pressure regulating valve (45) and the pressure fluid pipe (43).

The passage cross-section of the pressure fluid pipe (5) could decrease, e.g., due to the deposit of oil carbon, to such an extent that the compressed air in the compression chamber (25), and therefore, also in the pressure chamber (6) of the compressor, can no longer flow unhindered through the pressure regulating valve (45) to the compressed-air supply container (44). This hindered flow increases the pressure in the pressure chamber (6) and in the compression chamber (25) of the compressor. Since the control chamber (28) of the control valve (26) is connected to the pressure chamber (6) of the compressor via the pressure fluid pipe (8) and the pipe (9), the pressure accumulating in the pressure chamber (6) also increases the pressure in the control chamber (28) of the control valve (26).

The pressure in the pressure chamber (6) of the compressor and, therefore, also in the control chamber (28) of the control valve (26), eventually rises to the extent that it exceeds the maximum value predetermined by the spring (36) of the control valve (26). At this pressure level, the force exerted by the pressure in the control chamber (28) on the control piston (39) becomes greater than the opposing force of the spring element (36) exerted upon the control piston (39). This pressure level in the control chamber (28) suddenly brings the control piston (39) from its first switching position into its second switching position. In the first switching position, the second pressure fluid connection (34) is connected to control output (38) and the control output (38) is sealed off from the control chamber (28). In the second switching position, the control output (38) is connected to the control chamber (28) and the second pressure fluid connection (34) is sealed off from control output (38). The control piston (39) is held in the second switching position by the catch. The catch has a spring-loaded ball (31) and recesses (30, 33) in the side of the housing (35).

Pressure fluid then goes from the pressure fluid pipe (8) and the control chamber (28) to the control connection (52) of the switchable coupling (51) and subjects the pneumatic switching element of the switchable coupling (51) to pressure. This connection is through the bore (40) in the control piston (39), the control output (38) and the pressure fluid pipe (48).

The switchable coupling (51) is now switched over in such a manner that it separates the drive shaft (50) of the engine (49) from the drive shaft (53) of the compressor. Therefore, the piston (24) of the compressor is no longer driven and the action of the compressor is discontinued.

Overloading of the compressor is impossible because, in addition to monitoring the receiving-end pressure, e.g., the pressure in the compressed-air supply container (44), by means of the pressure regulating valve (45), the pressure in the cylinder (1) is also monitored by means of the control valve (26).

When the defect has been eliminated, e.g., by replacing the pressure fluid pipe (5), the control valve (26) is reset manually or automatically into its first switching position.

This seals off the control output (38) from the control chamber (28) and connects the control output (38) to the second pressure fluid connection (34).

Now, the pressure at the control connection (52) of the switchable coupling (51) bleeds off into the atmosphere causing the pneumatic switching element of the switchable coupling (51) to be switched over. The connection of the control connection (52) to the atmosphere is through the pressure fluid pipe (48), the first pressure fluid chamber (37) of the control valve (26), the pressure fluid pipe (47) and the pressure regulating valve (45). In this state, the switchable coupling (51) connects the drive shaft (50) of the engine (49) to the drive shaft (53) of the compressor.

Thereafter, the compressor compresses the air sucked in through the suction valve (54) and feeds the air through the pressure valve (3) and the pressure chamber (6) into the pressure fluid pipe (5).

The pressure regulating valve (45) need not be installed at one end of the pressure fluid pipe (5), between the pressure chamber (6) of the compressor and the compressed-air supply container (44). Instead, a pressure regulating device can be installed on the cylinder head (2) or on the cylinder head cover (11) and controlled by the receiver-end pressure.

Figure 5:
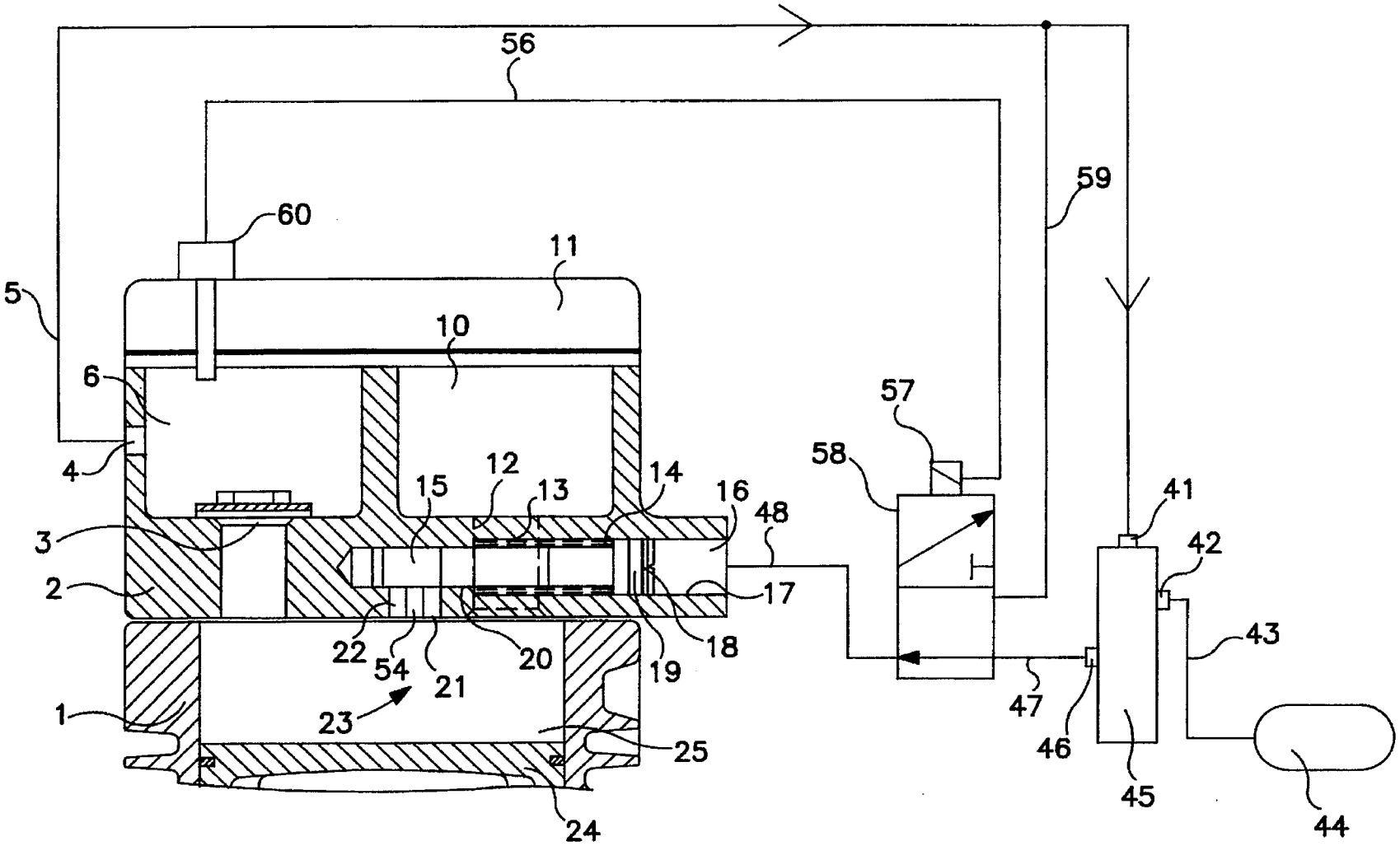
FIG. 5 shows a fifth embodiment of the invention with a pressure sensing device.

In a second embodiment of the control valve (26) illustrated in FIG. 5, the sensing device can also be made in the form of a pressure-sensing or force-sensing device (60) with a pressure-sensing or force-sensing element. This sensing device can be preferably located in or on the cylinder head (2) or the cylinder head cover (11). Such a pressure-sensing or force-sensing device (60) is designed so that when the pressure chamber (6) or the compression chamber (25) is subjected to a pressure of predetermined level, the device produces an electric signal which is conveyed via line (56) to the solenoid (57) of multi-path solenoid valve (58). This electric signal is produced at the electric control output of the sensing device and is a function of the pressure in the pressure chamber (6) or of the pressure in the compression chamber (25).

Figure 3:
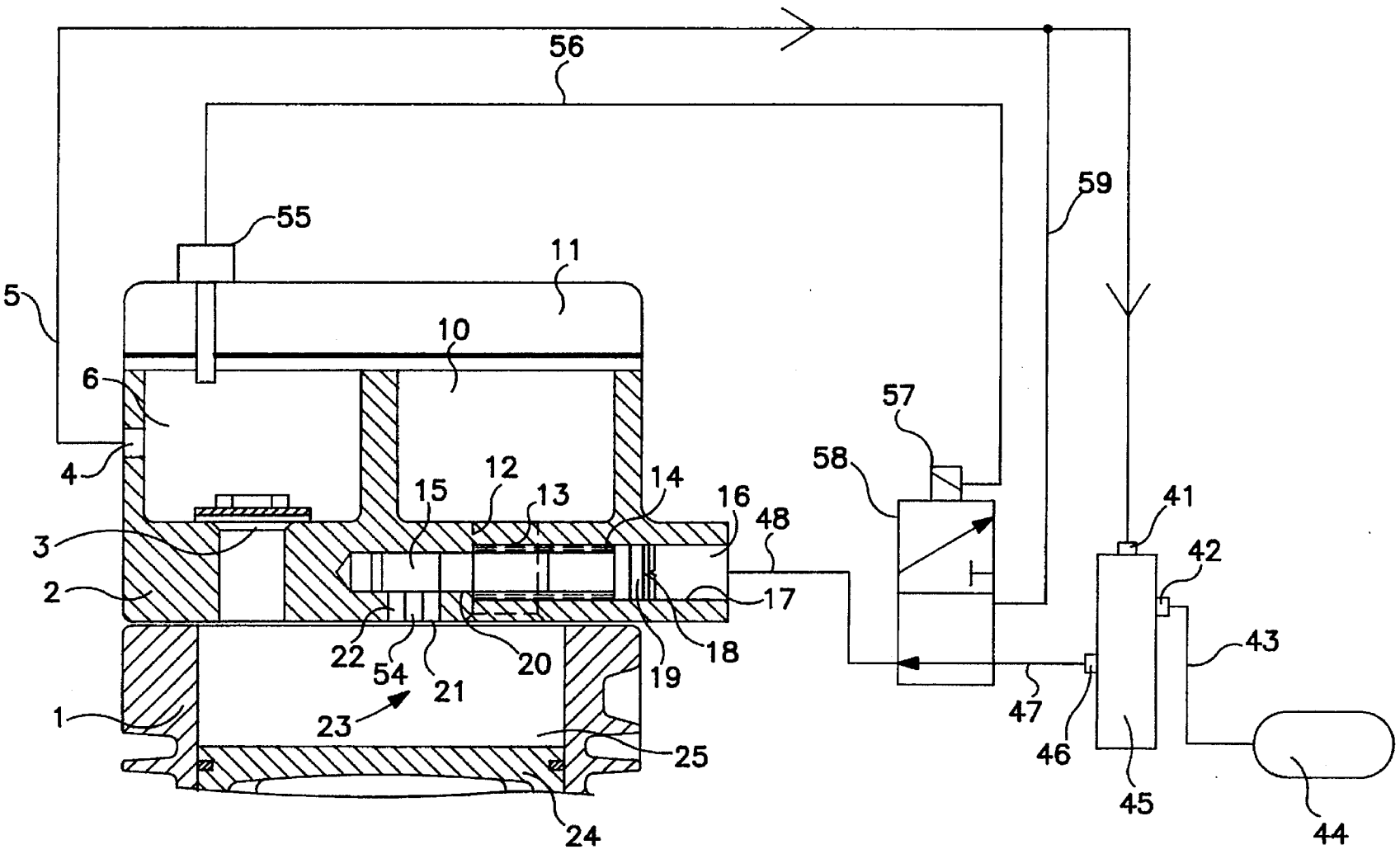
FIG. 3 shows a third embodiment of the invention with a temperature sensing device.

The electric signal is transmitted to the electric control input of a solenoid-actuated multi-path valve, i.e., electrically-actuated. The solenoid-actuated multi-path valve (58) could be a 3-way valve as shown in FIG. 3 and FIG. 5. This valve can connect selectively the pneumatic control input (16, 52) of the device for the discontinuation of compressing action (23, 51) to the control output (46) of the pressure regulating valve (45), or to the pressure chamber (6), or to the compression chamber (25) of the compressor, or to some other source of pressure fluid.

When an electric signal is present at the control output of the pressure-sensing or force-sensing device (60), the multi-path valve switches over. The switched valve selectively connects the control input of the device for the discontinuation of compressing action to the pressure chamber, or to the compression chamber of the compressor, or to some other pressure fluid source. Furthermore, the switched valve seals off the control input of this device for the discontinuation of the compressing action from the control output of the pressure regulating valve. In the absence of this signal, the multi-path valve switches over to a default state. In the default state, the multi-path valve seals off the control input of the device for the discontinuation of the compressing action from the pressure chamber, or from the compression chamber of the compressor, or from the other source of pressure fluid. Moreover, in the default state, the multi-path valve connects the control input of this device for compressing action discontinuation to the control output of the pressure regulating valve.

The above-mentioned multi-path valve is provided with a pressure fluid output, a first pressure fluid input, a second pressure fluid input and an electric control input. The electric control input of the multi-path valve is connected to the electric control output of the pressure-sensing or force-sensing device. The pressure fluid output, which serves as a control output, is connected to the pneumatic control input (17) of the device for the discontinuation of the compressing action (23). The first pressure fluid input is connected to the control output (46) of the pressure regulating valve (45). The second pressure fluid input of the multi-path valve is connected to the pressure chamber (6), the compression chamber (25) of the compressor or to some other source of pressure fluid.

In the embodiment of the sensing device described above, the electrically or solenoid-actuated multi-path valve replaces the valve elements of the control valve (26). Similarly, the spring (36) and the control piston (39), which serve as the pressure-sensing or force-sensing device in the control valve (26), are replaced by the pressure-sensing or force-sensing device of the embodiment having the solenoid-actuated multi-path valve.

In a third embodiment of the control valve (26) illustrated in FIG. 3, it is also possible to provide a temperature-sensitive device (55), e.g., a temperature sensor, with an electric control output instead of a pressure-sensitive device, e.g., pressure or force sensor. The temperature-sensitive device (55) could be on or in the cylinder head or on some other part of the cylinder of the compressor. The temperature-sensitive device (55) produces an electric control signal at its control output when the operating temperature of the compressor is exceeded which is conveyed via line (56) to the solenoid (57) of multi-path solenoid vale (58).

The temperature-sensitive device interacts with the solenoid-actuated multi-path valve in the same manner as the above-described sensing device which consists of a pressure-sensing or force-sensing device (60) and a multi-path solenoid valve. The sensing device is then made up of the temperature-sensitive device (55) and the multi-path valve (58).

If the device for the discontinuation of compressing action (51) is provided exclusively with electrically or solenoid-actuated switching means or adjusting means, the above-mentioned multi-path solenoid valve can be omitted. The electric control output of the pressure or force-sensing device, e.g., pressure sensor or force sensor, or the electric control output of the temperature-sensitive device, e.g., temperature sensor, is then connected to the electric control input of the device for the discontinuation of the compressing action. In that case, it is advantageous to monitor the receiving-end pressure by means of a pressure-sensing or force-sensing device with an electric control output. Furthermore, it is advantageous to connect the electric control output of the pressure-sensing or force-sensing device (60) to the electric control input of the device for the discontinuation of compressing action.

Figure 4:
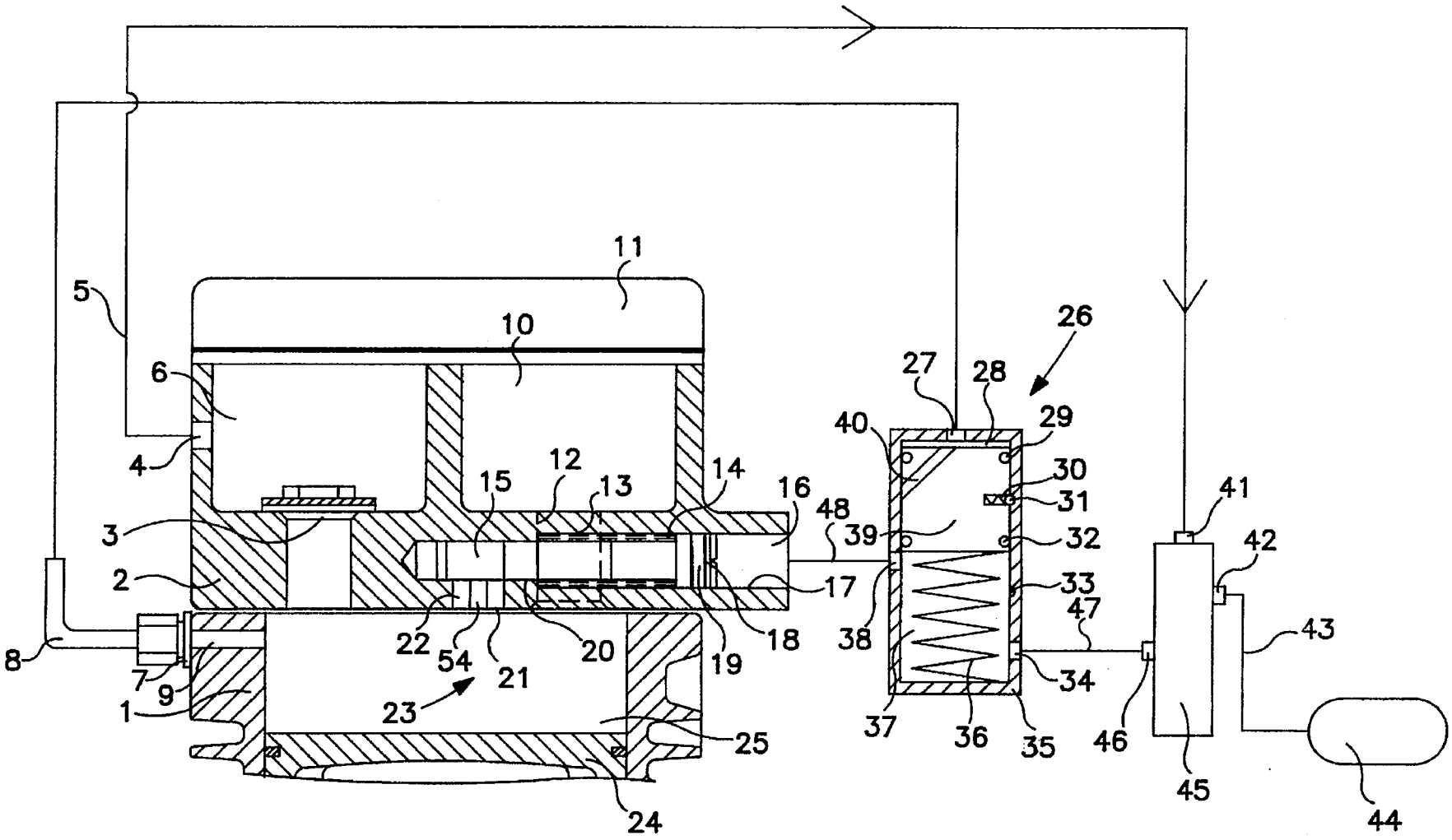
FIG. 4 shows fourth embodiment of the invention.

In a fourth embodiment of the invention illustrated in FIG. 4, the pressure fluid connection (9,7) is mounted on the wall of cylinder (1) so that control chamber (28) of sensing device (26) is connected to compression chamber 25. In all other respects, the embodiment shown in FIG. 4 is identical to that shown in FIG. 1.

Finally, the above described embodiments of the invention are intended to be illustrative only. Numerous alternative embodiments may be devised by those skilled in the art without departing from the spirit and scope of the following claims.

We claim:

1. A device for the production of compressed gas, comprising a compressor which provides a compressing action driven by a driving device, wherein said compressor comprises a compression chamber, a suction chamber and a pressure chamber, a suction valve connecting said compression chamber to said suction chamber, a pressure valve connecting said compression chamber to said pressure chamber, a pressure fluid connection and a pressure fluid pipe connecting said pressure chamber to a receiving end, said receiving end being a compressed-air supply container, a cut-off device discontinuing said compressing action when a receiving-end pressure reaches a predetermined value, wherein said cut-off device comprises a control input, and a sensing device comprising a control output, wherein said sensing device outputs a control signal at said control output when one of the pressure in said pressure chamber or the pressure in said compression chamber reaches said predetermined pressure values or the operating temperature of a predetermined element of said compressor reaches a predetermined temperature value, and said control signal is inputted to said control input of said cut-off device, said control signal actuates said cut-off device which discontinues said compressing action.

2. The device of claim 1, wherein said cut-off device comprises a controllable valve.

3. The device of claim 1, wherein said cut-off device comprises a switchable coupling which connects or disconnects said compressor to a drive element.

4. The device of claim 1, wherein said cut-off device comprises a pneumatic control input and a pressure-fluid actuated adjustable switching element for the actuation of said cut-off device.

5. The device of claim 1, wherein said cut-off device comprises an electric control input and an electrically solenoid-actuated adjustable switching element.

6. The device of claim 5, wherein said sensing device is a temperature-sensitive device, said control output of said sensing device is an electric control output which is connected to said electric control input of said cut-off device and said temperature-sensitive device is located on said compressor.

7. The device of claim 5, wherein said sensing device comprises a pressure-sensing device which is subjected to the pressure of one of said pressure chamber and said compression chamber, said control output is an electric control output outputting an electric control signal, and said electric control signal is a function of the pressure of one of said pressure chamber and said compression chamber of the compressor, wherein said electric control output of the pressure-sensing device is inputted to said electric control input of said cut-off device.

8. The device of claim 1, wherein said sensing device comprises a pressure-sensing device which is subjected to the pressure of said pressure chamber and has an electric control output which outputs an electric control signal when said pressure of said pressure chamber reaches a predetermined level, a solenoid-actuated valve which is electrically energized, said solenoid-actuated valve comprises an electric control input, a first pressure fluid input, a second pressure fluid input and a pressure fluid output which serves as an control output, and a pressure regulating valve which is located between said pressure chamber and said receiving end, and has a control output, wherein said first pressure fluid input of said solenoid-actuated valve is connected to said control output of said pressure regulating valve, said second pressure fluid input of said solenoid-actuated valve is connected to a source of pressure fluid, said control output of said solenoid-actuated valve is connected to a pneumatic control input of said cut-off device, said electric control input of said solenoid-actuated valve is connected to an electric control output of said pressure-sensing device, and said sensing device connects said pneumatic input of said cut-off device to said source of pressure fluid in the presence of said electric control signal of the pressure-sensing device and connects said pneumatic control input of said cut-off device to the control output of the pressure regulating valve in the absence of said electric control signal.

9. The device of claim 8, wherein said source of pressure fluid is one of the pressure chamber and the compression chamber.

10. The device of claim 1, wherein said sensing device comprises a temperature-sensing device which is installed on said compressor having an electric control output which outputs an electric control signal when the temperature of said compressor reaches a predetermined level, a solenoid-actuated valve which is electrically energized comprising an electric control input, a first pressure fluid input, a second pressure fluid input and a pressure fluid output which serves as a control output, and a pressure regulating valve which is located between the pressure chamber and a receiving end, and comprises a control output, wherein said first pressure fluid input of said solenoid-actuated valve is connected to said second control output, said second pressure fluid input of said solenoid-actuated valve is connected to a source of pressure fluid, said control output of said solenoid-actuated valve is connected to the pneumatic control input of said cut-off device, said electric control input of said solenoid-actuated valve is connected to the electric control output of the temperature-sensing device, and said sensing device connects the pneumatic input of said cut-off device to said source of pressure fluid in the presence of said electric control signal of the pressure-sensing device, and which connects the pneumatic control input of said cut-off device to the control output of the pressure regulating valve in the absence of said electric signal.

11. The device of claim 10, wherein said source of pressure fluid is one of the pressure chamber and the compression chamber.

12. The device of claim 1, wherein said sensing device comprises a control piston which moves against a force of a spring element, a control chamber connected to the pressure chamber or to the compression chamber of the compressor, said control piston having a side facing away from said spring element, wherein said side delimits said control chamber, and a valve which is actuated by said control valve piston and connects a source of pressure fluid to said control input of said cut-off device, wherein said control valve piston brings said valve into a position which connects said control input of said cut-off device to said source of pressure fluid when a pressure in said control chamber is greater than said force of said spring element acting on said control piston.

13. The device of claim 12, wherein said control valve comprises a pressure fluid-actuated 3/2-way valve, a first pressure fluid connection, a second pressure fluid connection, and a third pressure fluid connection serving as said control output of said sensing device, wherein said first pressure fluid connection is a control input of said pressure fluid-actuated 3/2-way valve and is connected to one of said pressure chamber and said compression chamber of the compressor, said second pressure fluid connection is connected to a control output of a pressure regulating valve, said pressure regulating valve is located between one of said pressure chamber and the compression chamber of the compressor and the receiving end.

14. The device of claim 1, wherein said sensing device further comprises a control valve, a spring element, a control piston which is moved against the force of said spring element, a control chamber delimited by a side facing away from said spring element of said control piston, a first pressure fluid connection connected to said control chamber, a second pressure fluid connection and a third control output, wherein said first pressure fluid connection is connected on one end to said control chamber and on another end to one of said pressure chamber and said compression chamber of the compressor, said second pressure fluid connection is connected to a control output of a pressure regulating valve, the pressure chamber of the compressor is connected to one of said pressure fluid source and a pressure fluid sink, via said pressure regulating valve, said third control output is connected to a pneumatic control connection of said cut-off device, located at said pneumatic control input of said cut-off device, said first, second and third pressure fluid connections are positioned so that said one end of said first pressure fluid connection connected to said control chamber is sealed off from the second control output and from said third pressure fluid connection by means of a valve element actuated by said control piston, said third control output is connected to said second pressure fluid connection when the force of the pressure from one of said pressure chamber and said compression chamber of the compressor acting upon the control piston is weaker than the opposing force of the spring element, and said one end of said first pressure fluid connection connected to said control chamber is connected to said third control output and said third control output is sealed off from said second pressure fluid connection by means of said valve element when the force of the pressure from one of said pressure chamber and said compression chamber of the compressor acting upon the control piston is greater than the force of said spring element acting upon said spring element in the opposite direction.

15. The device of claim 14, wherein said valve element is said control piston.

16. The device of claim 14, wherein said control piston further comprises an elastic-loaded component located in an outer circumferential wall of said control piston, wherein said elastic-loaded component extends to an inner wall of the housing of the control valve containing the control piston and interacts with at least one recess in the inner wall of the housing in the manner of a catch connection.

17. The device of claim 16, wherein said elastic-loaded component is a spring-loaded component.

* * * * *